US011633824B2

(12) United States Patent
Lin et al.

(10) Patent No.: US 11,633,824 B2
(45) Date of Patent: Apr. 25, 2023

(54) GRINDING CAVITY BODY OF MULTIPLE VIBRATION SOURCES

(71) Applicant: National Chung-Shan Institute of Science and Technology, Taoyuan (TW)

(72) Inventors: Po-Shen Lin, Taoyuan (TW); Ming-Wei Liu, Changhua County (TW); Chih-Peng Chen, Taoyuan (TW); Kuo-Kuang Jen, Taoyuan (TW)

(73) Assignee: National Chung-Shan Institute of Science and Technology, Taoyuan (TW)

( * ) Notice: Subject to any disclaimer, the term of this patent is extended or adjusted under 35 U.S.C. 154(b) by 797 days.

(21) Appl. No.: 16/718,222

(22) Filed: Dec. 18, 2019

(65) Prior Publication Data

US 2021/0187686 A1 Jun. 24, 2021

(51) Int. Cl.

| | |
|---|---|
| ***B24B 31/00*** | (2006.01) |
| ***B24B 31/06*** | (2006.01) |
| ***B24B 31/10*** | (2006.01) |
| ***B24B 1/04*** | (2006.01) |
| ***B06B 1/06*** | (2006.01) |

(52) U.S. Cl.

CPC ..... *B24B 1/04* (2013.01); *B06B 1/0607* (2013.01); *B24B 31/06* (2013.01)

(58) Field of Classification Search

CPC ..... B24B 31/00; B24B 31/027; B24B 31/06; B24B 31/10

USPC ..... 451/32, 35, 74, 113, 326, 328, 910

See application file for complete search history.

(56) References Cited

U.S. PATENT DOCUMENTS

| | | | | |
|---|---|---|---|---|
| 4,586,293 | A * | 5/1986 | De Spain | B24B 31/062 451/36 |
| 5,688,364 | A | 11/1997 | Sato | |
| 5,997,383 | A * | 12/1999 | Tseng | B24B 31/06 451/36 |
| 7,238,085 | B2 * | 7/2007 | Montierth | A61B 8/546 451/910 |
| 2009/0301764 | A1 * | 12/2009 | Kawamura | B24B 31/06 451/36 |
| 2011/0278231 | A1 * | 11/2011 | Nishijima | B24B 1/04 210/695 |
| 2019/0126540 | A1 | 5/2019 | Rule | |
| 2021/0187686 | A1 * | 6/2021 | Lin | B24B 31/06 |
| 2021/0187699 | A1 * | 6/2021 | Lin | B24B 31/06 |

FOREIGN PATENT DOCUMENTS

| | | | | |
|---|---|---|---|---|
| CN | 105522445 A | * | 4/2016 | B24B 1/00 |
| CN | 105643375 A | * | 6/2016 | B24B 1/04 |
| CN | 109623510 A | | 4/2019 | |
| CN | 110315399 A | * | 10/2019 | |

(Continued)

*Primary Examiner* — Eileen P Morgan

(74) *Attorney, Agent, or Firm* — Winston Hsu

(57) ABSTRACT

The present invention discloses a grinding cavity body of multiple vibration sources, in which a plurality of ultrasonic vibration sources are disposed, capable of controlling the multi-directional macroscopic medium flow, making benefits to the vibration medium (the abrasive of the slurry) to enter the fine structure of the workpiece to be processed, and to the abrasive to vibrate itself slightly to enhance the performance of abrasive to the workpiece which needs to be ground.

10 Claims, 2 Drawing Sheets

(56) References Cited

FOREIGN PATENT DOCUMENTS

| | | | | | |
|---|---|---|---|---|---|
| EP | 3838484 | A1 * | 6/2021 | ..... | B24B 1/04 |
| EP | 3838485 | A1 * | 6/2021 | ..... | B24B 1/04 |
| WO | WO-0032354 | A2 * | 6/2000 | ..... | B24B 31/006 |

* cited by examiner

GRINDING CAVITY BODY OF MULTIPLE VIBRATION SOURCES

BACKGROUND OF THE INVENTION

1. Field of the Invention

The present invention relates to a vibration grinding technology, and more particularly, to a grinding cavity body of multiple vibration sources capable of treating complex surfaces and complex flow paths of additive layer manufacturing.

2. Description of the Prior Art

To ensure that the surface roughness of a processed workpiece meets utilization requirements, there are many equipment and technologies for surface treatment currently, such as sandblast machine, ultrasonic lapping machine, abrasive flow machine, vibration grinding machines, etc. The object with better surface roughness may be obtained from the uneven surface produced by various grinding techniques. Before grinding, the surface of the workpiece was in a matte due to the surface roughness. After grinding, the surface roughness was significantly reduced to show a bright surface, and the detailed surface could meet the requirements of the workpiece.

Regarding surface grinding equipment, the vibration grinder is commonly applied in the art. The main structure of the vibration grinder is a cavity body. A vibration source is disposed outside the cavity, and a vibration medium (abrasive, which can be solid or liquid) and a workpiece to be ground are disposed inside the cavity. After the vibration source is turned on, the workpiece and the abrasive rub each other with the tiny relative movement therebetween, such that the protruding material on the surface of the workpiece may be removed, so as to complete grinding the surface of the workpiece.

Most of the commercial vibration grinders use a motor as the vibration source, disposed below the vibration cavity, and a vibration adjustment device, configured to adjust the amplitude. This structure of the vibration grinder makes the abrasive flow converge toward a center of the cavity body to form a single fixed flow pattern. Therefore, there is a single directional rubbing between the abrasive and the workpiece to be ground. In other words, the workpiece will be ground in another direction after the vibration direction changed, but the grinding procedure is in low efficiency because of the direction of the medium flow and the centroid of the workpiece, causing a limited efficiency for grinding improvement.

In addition, because the direction of single flow pattern is fixed, it cost a lot of time for treating complex surfaces. And, because the abrasive cannot reach the curved deep surface in single flow pattern, some position of the surface cannot be ground, which reduces the efficiency of grinding operations Moreover, a single motor is applied as a vibration source in the prior art. Because the vibration frequency of the motor is not high, it can only make the grinding in the direction of the macroscopic flow and limit the performance of grinding.

SUMMARY OF THE INVENTION

It is therefore a primary objective of the present invention to provide a grinding cavity body of multiple vibration sources, which is more efficient than conventional vibration grinder, to improve over disadvantages of the prior art. The present invention discloses a grinding cavity body of multiple vibration sources, in which a plurality of ultrasonic vibration sources are disposed, capable of controlling the multi-directional macroscopic medium flow, making benefits to the vibration medium (the abrasive of the slurry) to enter the fine structure of the workpiece to be processed, and to the abrasive to vibrate itself slightly to enhance the performance of abrasive to the workpiece which needs to be ground. The present invention disclosures that by adjusting of amplitudes and frequencies of the vibration sources on the bottom cavity body, the multi-directional flow pattern may be formed in the cavity body to achieve grinding in any direction.

The present invention discloses a grinding cavity body of multiple vibration sources, comprising a cavity body, configured to contain an abrasive slurry; and a plurality of ultrasonic vibration sources, disposed on a bottom of the cavity body, wherein the plurality of ultrasonic vibration sources are classified as strong ultrasonic vibration sources and weak ultrasonic vibration sources according to vibration frequencies, and the weak ultrasonic vibration sources are disposed outside the strong ultrasonic vibration sources; wherein the plurality of strong ultrasonic vibration sources and weak ultrasonic vibration sources respectively generate ultrasonic vibrations in two different frequencies to make the abrasive slurry flow upward from the bottom of the cavity body and spread out from the center of the cavity body.

The present invention discloses a grinding cavity body of multiple vibration sources, comprising a cavity body, configured to contain an abrasive slurry; and a plurality of ultrasonic vibration sources, disposed on a bottom of the cavity body, wherein the plurality of ultrasonic vibration sources are classified as strong ultrasonic vibration sources and weak ultrasonic vibration sources according to vibration frequencies, and the weak ultrasonic vibration sources are disposed inside the strong ultrasonic vibration sources; wherein the plurality of strong ultrasonic vibration sources and weak ultrasonic vibration sources respectively generate ultrasonic vibrations in two different frequencies to make the abrasive slurry flow upward from the bottom of the cavity body and converge toward a center of the cavity body.

In an embodiment of the present invention, the plurality of vibration frequencies of the ultrasonic vibration sources are 10 KHz-50 KHz, and the vibration frequencies and amplitudes can be adjusted during the grinding process, to meet the requirements of the different workpiece and grinding mediums.

In an embodiment of the present invention, the plurality of ultrasonic vibration sources are arranged as a rectangle on the bottom of cavity body.

In an embodiment of the present invention, the plurality of ultrasonic vibration sources are arranged as a circle on the bottom of cavity body.

In an embodiment of the present invention, the cavity body is polygonal with at least four sides, or cylindrical.

In order to make the objects, technical solutions and advantages of the present invention become more apparent, the following relies on the accompanying drawings and embodiments to describe the present invention in further detail.

These and other objectives of the present invention will no doubt become obvious to those of ordinary skill in the art after reading the following detailed description of the preferred embodiment that is illustrated in the various figures and drawings.

DETAILED DESCRIPTION

The embodiments stated below are utilized for illustrating the concept of the present application. Those skilled in the art can readily understand the advantages and effects of the present invention disclosed by the application.

Figure 1:
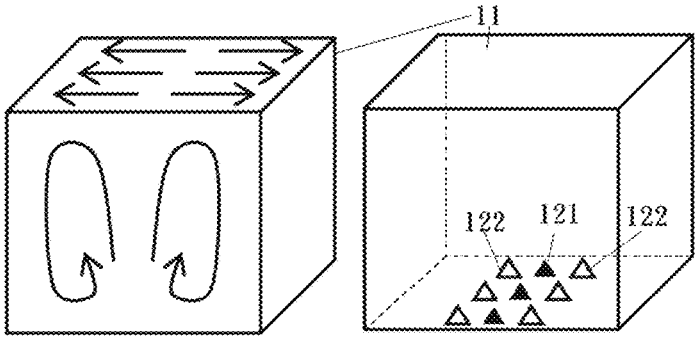
FIG. 1 is a schematic diagram of a grinding cavity body of multiple vibration sources according to a first embodiment of the present invention

FIG. 1 is a schematic diagram of a grinding cavity body of multiple vibration sources according to a first embodiment of the present invention. The first embodiment comprises: a cuboid cavity body 11, configured to contain an abrasive slurry; at least one strong ultrasonic source 121, disposed at a center of a bottom of the cuboid cavity body 11, wherein the vibration frequency of the strong ultrasonic vibration sources 121 is at 35 KHz-50 KHz; and at least two weak ultrasonic vibration sources 122, disposed on the bottom of the cuboid cavity body 11, located on both sides of the plurality of strong ultrasonic vibration sources 121, wherein the vibration frequencies of the weak ultrasonic vibration sources 122 are at 10 KHz-30 KHz; wherein the plurality of strong ultrasonic vibration sources 121 and the plurality of weak ultrasonic vibration sources 122 are arranged as a rectangle on the bottom of the cuboid cavity body 11, the plurality of strong ultrasonic vibration sources 121 and the plurality of weak ultrasonic vibration sources 122 generate ultrasonic vibrations to make the abrasive slurry in the cuboid cavity body 11 flow upward from the bottom of the cuboid cavity body 11 and spread out from the center of the cuboid cavity body 11 (as shown in FIG. 1).

Figure 2:
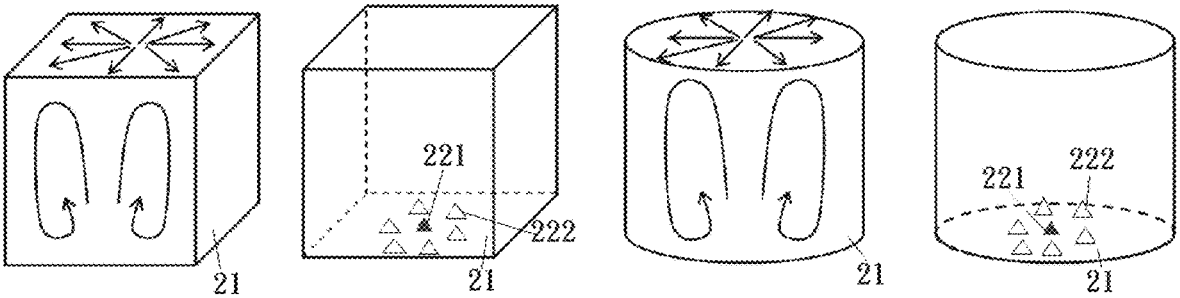
FIG. 2 is a schematic diagram of a grinding cavity body of multiple vibration sources according to a second embodiment of the present invention.

FIG. 2 is a schematic diagram of a grinding cavity body of multiple vibration sources according to a second embodiment of the present invention. The second embodiment comprises: a cavity body 21 (which may be cylindrical or cuboid), configured to contain an abrasive slurry; at least one strong ultrasonic vibration source 221, disposed at a center of a bottom of the cavity body 21, wherein the vibration frequency of the strong ultrasonic vibration source 221 is at 35 KHz-50 KHz; and at least two weak ultrasonic vibration sources 222, disposed on the bottom of the cavity body 21, located around the strong ultrasonic vibration source 221, wherein the vibration frequencies of the weak ultrasonic vibration sources 222 are at 10 KHz-30 KHz; wherein the strong ultrasonic vibration source 221 and the plurality of weak ultrasonic vibration sources 222 are arranged as a circle on the bottom of the cavity body 21, the strong ultrasonic vibration source 221 and the plurality of weak ultrasonic vibration sources 222 generate ultrasonic vibrations to make the abrasive slurry in the cavity body 21 flow upward from the bottom of the cavity body 21 and spread out from the center of the cavity body 21.

Figure 3:
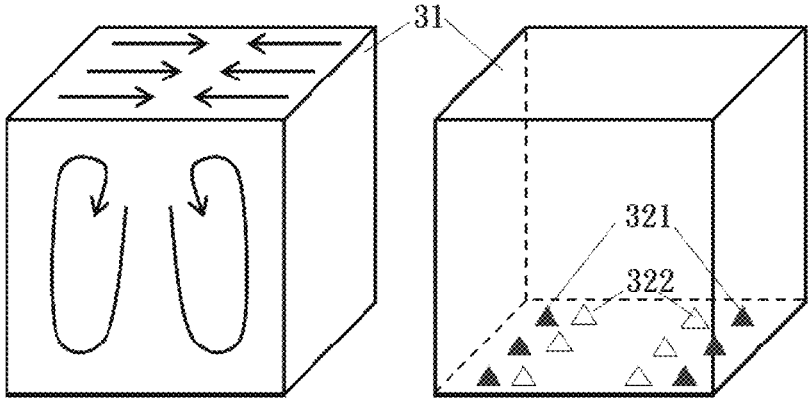
FIG. 3 is a schematic diagram of a grinding cavity body of multiple vibration sources according to a third embodiment of the present invention.

FIG. 3 is a schematic diagram of a grinding cavity body of multiple vibration sources according to a third embodiment of the present invention. The third embodiment comprises: a cuboid cavity body 31, configured to contain an abrasive slurry; at least one weak ultrasonic source 322, disposed at a bottom of the cuboid cavity body 31, wherein the vibration frequency of the weak ultrasonic vibration source 322 is at 10 KHz-30 KHz; and at least two strong ultrasonic vibration sources 321, disposed on the bottom of the cuboid cavity body 31, located on both sides of the weak ultrasonic vibration source 322, wherein the vibration frequencies of the strong ultrasonic vibration sources 321 are at 35 KHz-50 KHz; wherein the plurality of strong ultrasonic vibration sources 321 and the weak ultrasonic vibration source 322 are arranged as a rectangle on the bottom of the cuboid cavity body 31, the plurality of strong ultrasonic vibration sources 321 and the weak ultrasonic vibration source 322 generate ultrasonic vibrations to make the abrasive slurry in the cuboid cavity body 31 flow upward from the bottom of the cuboid cavity body 31 and converge toward the center of the cuboid cavity body 31 (as shown in FIG. 3).

Figure 4:
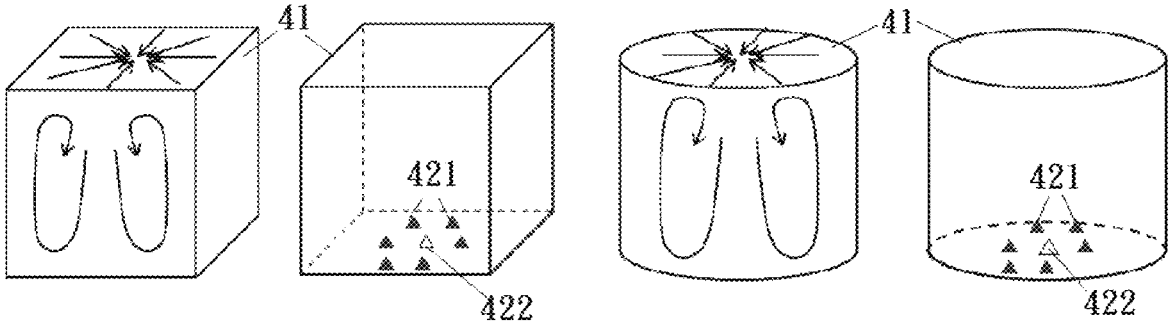
FIG. 4 is a schematic diagram of a grinding cavity body of multiple vibration sources according to a fourth embodiment of the present invention.

FIG. 4 is a schematic diagram of a grinding cavity body of multiple vibration sources according to a fourth embodiment of the present invention. The fourth embodiment comprises: a cavity body 41 (which may be cylindrical or cuboid), configured to contain an abrasive slurry; at least one weak ultrasonic vibration source 422, disposed at a center of a bottom of the cavity body 41, wherein the vibration frequency of the weak ultrasonic vibration source 422 is at 10 KHz-30 KHz; and at least two strong ultrasonic vibration sources 421, disposed on the bottom of the cavity body 41, located around the weak ultrasonic vibration source 422, wherein the vibration frequencies of the strong ultrasonic vibration sources 421 are at 35 KHz-50 KHz; wherein the plurality of strong ultrasonic vibration sources 421 and the weak ultrasonic vibration source 422 are arranged as a circle on the bottom of the cavity body 41, the plurality of strong ultrasonic vibration sources 421 and the weak ultrasonic vibration source 422 generate ultrasonic vibrations to make the abrasive slurry in the cavity body 41 flow upward from the bottom of the cavity body 41 and converge toward the center of the cavity body 41.

Therefore, the present invention provides a grinding cavity body of multiple vibration sources and a new control method for vibration grinding cavity body with multi-directional flow pattern. Different from applying a single motor as a vibration source in the prior art, the present invention includes at least a vibration source in the bottom of the cavity body (which may be cylindrical or cuboid), and controls amplitudes (power) and frequencies of the at least one vibration sources (comprising high-frequency vibration sources, such as ultrasonic), such that the multi-directional macroscopic flow is formed in the cavity body while keeping the vibration medium to have the characteristics of the original micro vibrator. A grinding cavity body of multiple vibration sources of the present invention helps the vibration medium (the abrasive of the slurry) to enter the fine structure of the workpiece to be processed, and allows the abrasive to generate slight vibration itself, so as to enhance the grinding efficiency between the abrasive and the workpiece to be ground. The present invention may be applied for surface polishing, deflashing, chamfering, deburring, rust removing, grinding, polishing, gloss finish, plating pretreatment, vibration polish in color, or other purposes of the surface treatment.

The foregoing embodiments are not intended to limit the present application. Those skilled in the art may make modifications and alterations accordingly and not limited herein. Therefore, the scope of the present invention should be as listed in the scope of the claims mentioned below.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A grinding cavity body of multiple vibration sources, comprising:

a cavity body, configured to contain an abrasive slurry; and a plurality of ultrasonic vibration sources, disposed on a bottom of the cavity body, wherein the plurality of ultrasonic vibration sources are classified as strong ultrasonic vibration sources and weak ultrasonic vibration sources according to vibration frequencies, and the weak ultrasonic vibration sources are disposed outside the strong ultrasonic vibration sources;

wherein the plurality of strong ultrasonic vibration sources and weak ultrasonic vibration sources respectively generate ultrasonic vibrations in two different frequencies to make the abrasive slurry flow upward from the bottom of the cavity body and spread out from the center of the cavity body.

2. The grinding cavity body of multiple vibration sources of claim 1, wherein the cavity body is polygonal with at least four sides, or cylindrical.

3. The grinding cavity body of multiple vibration sources of claim 1, wherein the vibration frequencies of the weak ultrasonic vibration sources are 10 KHz-30 KHz, and the vibration frequencies of the strong ultrasonic vibration sources are 35 KHz-50 KHz.

4. The grinding cavity body of multiple vibration sources of claim 1, wherein the plurality of ultrasonic vibration sources are arranged as a rectangle on the bottom of the cavity body.

5. The grinding cavity body of multiple vibration sources of claim 1, wherein the plurality of ultrasonic vibration sources are arranged as a circle on the bottom of the cavity body.

6. A grinding cavity body of multiple vibration sources, comprising:

a cavity body, configured to contain an abrasive slurry; and a plurality of ultrasonic vibration sources, disposed on a bottom of the cavity body, wherein the plurality of ultrasonic vibration sources are classified as strong ultrasonic vibration sources and weak ultrasonic vibration sources according to vibration frequencies, and the weak ultrasonic vibration sources are disposed inside the strong ultrasonic vibration sources;

wherein the plurality of strong ultrasonic vibration sources and weak ultrasonic vibration sources respectively generate ultrasonic vibrations in two different frequencies to make the abrasive slurry flow upward from the bottom of the cavity body and converge toward a center of the cavity body.

7. The grinding cavity body of multiple vibration sources of claim 6, wherein the cavity body is polygonal with at least four sides, or cylindrical.

8. The grinding cavity body of multiple vibration sources of claim 6, wherein the vibration frequencies of the weak ultrasonic vibration sources are 10 KHz-30 KHz, and the vibration frequencies of the strong ultrasonic vibration sources are 35 KHz-50 KHz.

9. The grinding cavity body of multiple vibration sources of claim 6, wherein the plurality of ultrasonic vibration sources are arranged as a rectangle on the bottom of the cavity body.

10. The grinding cavity body of multiple vibration sources of claim 6, wherein the plurality of ultrasonic vibration sources are arranged as a circle on the bottom of the cavity body.

* * * * *